US005998978A

United States Patent [19]

Connell et al.

[11] Patent Number: 5,998,978

[45] Date of Patent: Dec. 7, 1999

[54] APPARATUS AND METHOD FOR REDUCING ENERGY FLUCTUATIONS IN A PORTABLE DATA DEVICE

[75] Inventors: Lawrence Edwin Connell, Naperville; Patrick Lee Rakers, Kildeer; Timothy James Collins, Lockport; Donald Bernard Lemersal, Jr., Park Ridge, all of Ill.

[73] Assignee: Motorola, Inc., Schaumburg, Ill.

[21] Appl. No.: 09/106,475

[22] Filed: Jun. 29, 1998

[51] Int. Cl.[6] ..... G05F 1/56

[52] U.S. Cl. ..... 323/273

[58] Field of Search ..... 323/223, 224, 323/226, 268, 269, 270, 273; 327/379, 382, 387

[56] References Cited

U.S. PATENT DOCUMENTS 5,453,713 9/1995 Partovi et al. ..... 327/565

5,530,403 6/1996 Bushman et al. ..... 330/253

5,563,779 10/1996 Cave et al. ..... 363/59

5,694,074 12/1997 Kitade et al. ..... 327/589

*Primary Examiner*—Matthew Nguyen

*Attorney, Agent, or Firm*—Val Jean Hillman; James A. Coffing

[57] ABSTRACT

A portable data device employs an integrated circuit having a signal processor that receives a power signal from an external source via a power node. A decoupling device is placed between the power node and the signal processor. An energy reservoir is placed in parallel with the signal processor, which acts in concert with the decoupling device to isolate the effects of the signal processor from the rest of the integrated circuit.

17 Claims, 2 Drawing Sheets

-PRIOR ART-

-PRIOR ART-

APPARATUS AND METHOD FOR REDUCING ENERGY FLUCTUATIONS IN A PORTABLE DATA DEVICE

FIELD OF THE INVENTION

The invention is related generally to portable data devices, or smart cards, and more particularly to a method and apparatus for regulating the energy fluctuations created by circuits thereon.

BACKGROUND OF THE INVENTION

Portable data carriers (i.e., smart cards or chip cards) are known to include a plastic substrate within which a semiconductor device (i.e., integrated circuit—IC) is disposed for processing digital data. This digital data may constitute program instructions, user information, or any combination thereof. Moreover, these devices are known to be operational in a contacted mode, whereby an array of contact points disposed on the plastic substrate and interconnected with the semiconductor device is used to exchange electrical signals between the portable data carrier and an external card reader, or data communications terminal. Similarly, there exist smart cards that operate in a contactless mode, whereby a radio frequency (RF) receiving circuit is employed to exchange data between the card and a card terminal. That is, the card need not come in physical contact with the card terminal in order to exchange data therewith, but rather must simply be placed within a predetermined range of the terminal. Additionally, there exist smart cards that are alternatively operational in either a contacted mode or a contactless mode. Such cards are equipped with both RF receiving circuitry (for contactless operations) as well as an array of contact pads (for contacted operations), and are commonly referred to as dual mode smart cards.

Whether operating in the contacted or contactless mode, several problems plague the smart card designer. One such problem involves the energy fluctuations created by the integrated circuit on the smart card. These energy fluctuations, which can be caused by common switching noise from a digital signal processor or by current spikes reflective of processing activity, create two somewhat distinct problems during normal smart card operation; namely, receiver sensitivity to the switching noise and security breaches, as next described.

The problem of switching noise is most notable during contactless operation, whereby sensitive analog circuitry shares a common supply rail with the signal processing unit. Referring to FIG. 1, a smart card arrangement 100 includes a substrate 102 for housing the smart card circuitry. The power node 104 is used to supply power, via supply lines 106 and 108 ($V_{DD}$ and $V_{SS}$, respectively), to an optional analog circuit 110 and a signal processor 112. It should be noted that in contacted operation, the analog circuit is not required, as the signal processor 112 receives power directly from an external data communications terminal (not shown). However, in contactless operation, the analog circuit 110 is present, which may include sensitive circuitry whose performance degrades in response to switching noise generated by the signal processor 112. In particular, analog circuit 110 may be a data recovery circuit and required to recover a data signal from a power signal that is modulated with 10% amplitude shift keying (ASK). If the switching noise generated by the signal processor 112 is allowed to couple to the ASK modulated power signal, the data signal may become corrupted. Thus, the problem of switching noise must be addressed in order to improve performance during contactless operations.

Another problem, which exists in both contacted and contactless modes of operation, stems from the digital signature produced by the signal processor 112, wherein each data transfer and instruction execution will typically draw a different amount of energy (e.g., current). By monitoring the input power fluctuations associated with these events, sequences of instruction executions and data transfers can be determined, thereby increasing the likelihood of a security breach. For example, it would be a fairly straightforward, albeit arduous, task to extract encryption keys by monitoring the data transfers performed by the signal processor 112. Thus, the energy fluctuations present during normal operation, in either contacted or contactless mode, can be unscrupulously monitored, leading to an undesirable vulnerability to security breaches.

It is noted that the foregoing problems exist substantially in either the contacted or contactless mode. FIG. 2 shows a more detailed view of the power node shown in FIG. 1, whereby the different modes of power extraction are highlighted. In particular, an impedance network 104-1, which is typically either a magnetic/inductive coil or an electrostatic/capacitive circuit, can be used in the contactless mode to generate the supply rails 106, 108. It should be noted that this arrangement generally complies with ISO standard 14443. Similarly, terminal pads 104-2 constitute the contacted facilities by which the supply rails 106, 108 are supplied. It is noted that these pads, as well as the other pads shown (201–203, 205–207) correspond with the ISO standard 7816. It is further noted that the arrangements 104-1 and 104-2 can be present in isolation on the portable data device, or used in combination for the dual-mode smart card. It is through these mechanisms that security breaches can be undesirably facilitated.

U.S. Pat. No. 5,563,779, entitled "Method And Apparatus For A Regulated Supply On An Integrated Circuit" attempts to solve the problem of digital switching noise recited herein. This approach senses output voltage levels from a circuit and changes the value of a variable capacitor, which in turn modifies the supply voltage and corrects for the changing output level. Regretfully, the circuits used in the above approach do not respond quickly enough to digitally created switching noise, and are thus ineffective on a high-speed, mixed-mode integrated circuit such as those required in today's portable data devices.

Accordingly, there exists a need for an apparatus and method for reducing the deleterious effects of switching noise created by a signal processor on a smart card. In particular, an approach that was usable in a high-speed, mixed-mode integrated circuit would be an improvement over the prior art. Moreover, any device or method that further yielded enhanced security by virtue of reduced energy fluctuations during normal operations would provide a greater advantage over the prior art.

DETAILED DESCRIPTION OF A PREFERRED EMBODIMENT

The present invention encompasses a portable data device, i.e., smart card, that includes circuitry to alter the characteristics of an ingress energy path to a signal processor that generates energy fluctuations during operation. An ingress energy waveform is provided that is independent of these energy fluctuations, and an egress energy waveform is produced that is substantially equal and opposite to the ingress energy waveform. In this manner, the present invention overcomes the problems associated with digital switching noise, while simultaneously enhancing the security features of the portable data device.

Figure 1:
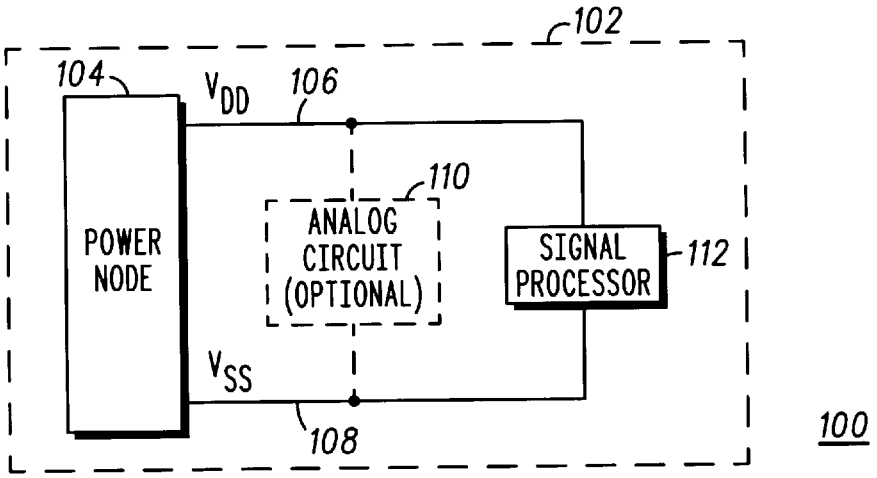
FIG. 1 shows a portable data device, as known in the prior art.
Figure 2:
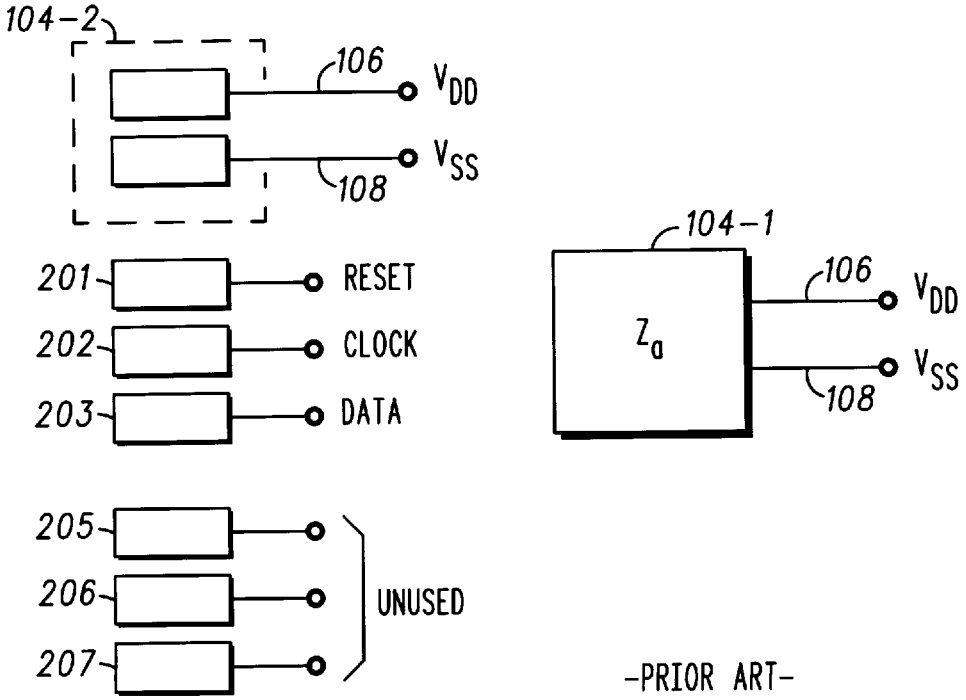
FIG. 2 shows a more detailed view of the power node shown in FIG. 1, indicating contactless and contacted modes of operation.
Figure 3:
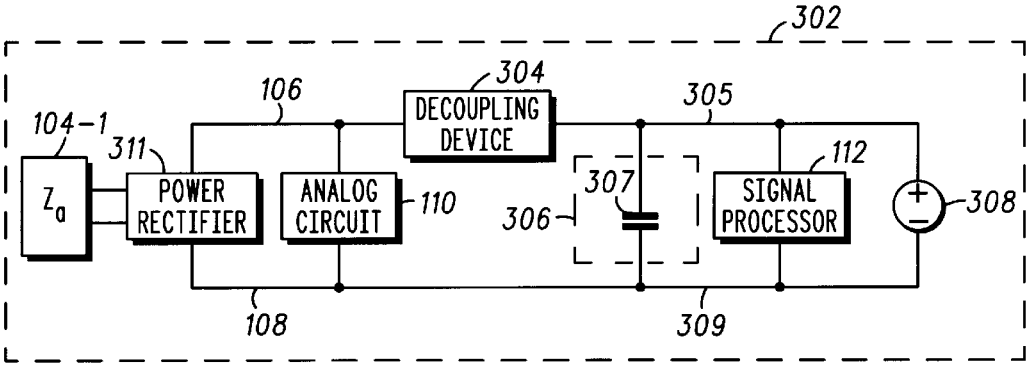
FIG. 3 shows a portable data device, that includes a decoupling device and an energy reservoir in accordance with the present invention.

FIG. 3 shows a portable data carrier 302 that includes a decoupling device 304 on the ingress energy path 305 to the signal processor 112. There is further coupled to the output of the decoupling device 304 an energy reservoir 306, disposed in parallel with the digital signal processor 112. In a preferred embodiment, the energy reservoir comprises a capacitive circuit 307, as shown. Also in parallel with the signal processor 112, a voltage regulator 308 is shown disposed between the ingress energy path 305 and the egress energy path 309.

In a contactless embodiment as shown in FIG. 3, power is supplied from impedance network 104-1 to analog circuit 110 and digital signal processor 112 through power rectifier 311. Signal processor 112 represents generically any block that exhibits large dynamic impedance variations during normal operation. These variations might take the form of switching noise associated with digital circuits, discrete time analog blocks, or other analog circuits such as oscillators, comparators, or class-AB amplifiers. Analog circuit 110 likewise represents generically any circuit that is sensitive to voltage fluctuations resulting from the destructive types of impedance variations cited above.

In accordance with the invention, decoupling device 304 is used to isolate analog circuit 110 from the impedance variations of digital signal processor 112. As a result, the impedance seen by analog circuit 110 is determined by decoupling device 304 and is independent of digital signal processor 112. To ensure proper operation of digital signal processor 112, voltage regulator 308 and capacitor 307 are used to maintain the voltage across digital signal processor 112 within its required operating voltage range. In particular, capacitor 307 functions as an energy reservoir and is used to supply the instantaneous current required during each signal processor switching event, while voltage regulator 308 is used to regulate the average voltage across digital signal processor 112.

Typically, decoupling device 304 is used to maintain the impedance seen by analog circuit 110 at a substantially constant value. However, for other applications, decoupling device 304 may be configured to allow this impedance to vary at a rate that does not substantially degrade the performance of analog circuit 110. For example, in a smart card application, the impedance might be varied in a manner that is commensurate with the rate at which the card is passed through a card reader's magnetic field. As the card is moved closer to the reader, where the available input power is greater, the impedance would be reduced, enabling more power to be supplied to digital signal processor 112. In this way, the maximum available input power could always be delivered to digital signal processor 112. In a preferred embodiment, analog circuit 110 is a data recovery circuit and is used to recover a data signals from an input power signal that is modulated with 10% amplitude shift keying (ASK). According the to the invention, the impedance of decoupling device 304 is varied at a rate that is substantially less than the input edge rate of the modulated data. Thus, any low frequency modulation distortion caused by varying the impedance of device 304 can be easily removed with a single pole high pass filter (not shown).

Figure 4:
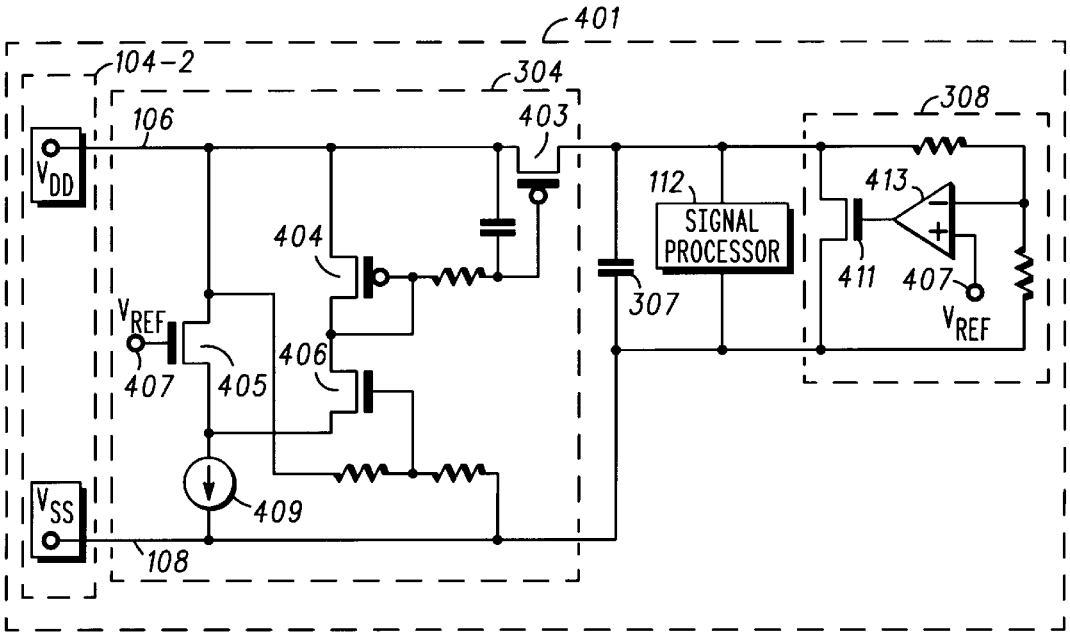
FIG. 4 shows a more detailed view of the decoupling device and a shunt regulator shown in FIG. 3.

FIG. 4 shows a portable data device 401, including a more detailed view of the decoupling device 304 and the voltage regulator 308. It should be noted that the power node for this embodiment includes the contacted terminal pads 104-2, but it is understood that such an arrangement can rely on an impedance network 104-1, and the other analog-specific circuitry shown in FIG. 3.

Decoupling device 304 is comprised of p-channel MOSFETs 403 and 404, n-channel MOSFETs 405 and 406, and constant current source 409. N-channel MOSFETs 405 and 406 constitute a differential pair, which performs a current steering function, as is well known. The relative gate voltages of NFETs 405 and 406 will determine how the current from current source 409 splits between NFETs 405 and 406. The device with the larger gate voltage will have a larger source current. PFETs 403 and 404 comprise a current mirror circuit, which, in a preferred embodiment, are sized such that the drain current in PFET 403 is approximately 100 times the drain current in PFET 404. The drain current for PFET 404 is substantially equal to the drain current of NFET 406, therefore the drain current in PFET 403 will be 100 times the drain current of NFET 406. The Vref voltage applied to node 407 is a fixed quantity. The gate voltage of NFET 406 is a fixed fraction, X, of the supply voltage Vdd applied at node 106. For X*Vdd significantly less than Vref, none of the current from current source 409 will flow in NFET 406 and consequently no current will flow through PFET 403. As the voltage X*Vdd is increased, some of the current from current source 409 will flow in NFET 406 and 100 times the current in NFET 406 will flow through PFET 403. When voltage X*Vdd equals Vref, the drain current of PFET 403 will be 50 times the current in current source 409 and for X*Vdd significantly greater than Vref, all of the current from current source 409 will flow through NFET 406 and the current through PFET 403 will reach its maximum value of 100 times the current source current. The differential voltage applied to the differential pair devices 405 and 406 controls the drain current of PFET 403. It is substantially independent of the voltage fluctuations that occur due to the activity of signal processor 112, as next shown.

Well known electronics principles suggest that the sum of the current flowing into capacitor 307, signal processor 112, and voltage regulator 308 must equal the current flowing out of PFET 403. Likewise, the currents flowing out of capacitor 307, signal processor 112, and voltage regulator 308 is exactly the same as the current flowing into these elements. As a result, the sum of the currents flowing out of capacitor 307, digital signal processor 112, and voltage regulator 308 is also exactly equal to the current flowing out of PFET 403, and therefore is independent of the activity of digital signal processor 112. The RC filter applied at the gate of PFET 403 determines the rate at which the drain current of PFET 403 is varied. According to a preferred embodiment of the invention, this rate is substantially less than the input data edge rate of the ASK modulated input power source.

Voltage regulator 308 is an active shunt regulator in the preferred embodiment. It is comprised of an operational amplifier 413 and shunt NFET 411. The high gain characteristic of operational amplifier 413 and the negative feedback through the resistor divider forces the minus input of operational amplifier 413 to be equal to the Vref voltage 407. This fixes the supply voltage for signal processor 112 to a desired level. Since voltage regulator 308 can only sink current, it is necessary that decoupling device 304 provide more current than required by the digital signal processor 112. Since the bandwidth of operational amplifier 413 is finite, capacitor 307 is needed to supply high frequency current required by digital signal processor 112 and prevent large, high frequency fluctuations in the supply voltage for digital signal processor 112.

In the foregoing manner, the present invention improves receiver sensitivity by greatly attenuating the voltage fluctuations on the received signal that result from digital interference. Additionally, the present invention improves security by reducing the amount of current fluctuation from digital switching visible over either a contacted or contactless interface. The beneficial properties of this invention result from the substantially constant input impedance of the decoupling circuit. This input impedance is independent of the signal processing element's time varying load impedance.

What is claimed is:

1. An integrated circuit, comprising:

a digital signal processor that receives a power signal from an external source via a power node;

a decoupling device disposed between the power node and the digital signal processor; and an energy reservoir disposed in parallel with the digital signal processor and operably coupled to the decoupling device.

2. The integrated circuit of claim 1, wherein the power node comprises an impedance network, and wherein the integrated circuit further comprises a power rectifier operably coupled to the impedance network.

3. The integrated circuit of claim 1, wherein the decoupling circuit comprises a transistor operating as a current source.

4. The integrated circuit of claim 3, wherein the current source comprises a current mirror circuit coupled in series with a reference current circuit.

5. The integrated circuit of claim 1, wherein the energy reservoir comprises a capacitor.

6. The integrated circuit of claim 1, wherein power to the integrated circuit is supplied via an amplitude shift keyed (ASK) modulated input power signal, and wherein the decoupling device is characterized by an impedance that varies at a rate substantially less than an input data edge rate of the ASK modulated input power signal.

7. A portable data device, comprising:

a power node for receiving a power signal from an external source; and an integrated circuit, comprising;

a digital processor;

a decoupling device disposed between the power node and the digital processor; and an energy reservoir disposed in parallel with the digital processor and operably coupled to the decoupling device.

8. The portable data device of claim 7, wherein the power node further comprises an impedance network, and wherein the impedance network further comprises a capacitive circuit coupled to the decoupling device.

9. The portable data device of claim 7, wherein the decoupling circuit comprises a variable current source.

10. The portable data device of claim 9, wherein the variable current source comprises a transistor operating as current source.

11. The portable data device of claim 7, wherein the power node comprises a first and second terminal pad, positioned on the portable data device to receive power from a data communications terminal.

12. The portable data device of claim 7, wherein power to the integrated circuit is supplied via an amplitude shift keyed (ASK) modulated input power signal, and wherein the decoupling device is characterized by an impedance that varies at a rate substantially less than an input data edge rate of the ASK modulated input power signal.

13. A portable data device, comprising:

an integrated circuit, comprising;

a digital processor;

an impedance network operably coupled to the digital processor;

a variable current source disposed between the impedance network and the digital processor; and an energy reservoir disposed in parallel with the digital processor wherein the impedance network comprises a capacitive circuit.

14. The portable data device of claim 13, wherein the variable current source comprises a current mirror circuit coupled in series with a reference current circuit.

15. The portable data device of claim 13, wherein the energy reservoir capacitor.

16. The integrated circuit of claim 1, further comprising a capacitor connected in parallel with the power node.

17. An integrated circuit, comprising:

a digital signal processor that receives a power signal from an external source via a power node;

a capacitor in connected in parallel with the power node;

a decoupling device disposed between the power node and the digital signal processor; and an energy reservoir connected in parallel with the digital signal processor and coupled to the decoupling device.

* * * * *

UNITED STATES PATENT AND TRADEMARK OFFICE

CERTIFICATE OF CORRECTION

PATENT NO. : 5,998,978

DATED : December 7, 1999

INVENTOR(S) : Lawrence E. Connell et al.

It is certified that error appears in the above-indentified patent and that said Letters Patent is hereby corrected as shown below:

Renumber claim 16 as 7

In claim 17, line 43, delete the word "in"

Signed and Sealed this

Third Day of April, 2001

*Attest:*

*Attesting Officer*

NICHOLAS P. GODICI

*Acting Director of the United States Patent and Trademark Office*